US007952850B1

(12) United States Patent
Finkel

(10) Patent No.: US 7,952,850 B1
(45) Date of Patent: May 31, 2011

(54) SYSTEMS AND METHODS FOR AN ELECTRONIC DEMOTIVATOR HAVING A RECOVERY SWITCH

(75) Inventor: Alan D. Finkel, Gilbert, AZ (US)

(73) Assignee: TASER International, Inc., Scottsdale, AZ (US)

( * ) Notice: Subject to any disclaimer, the term of this patent is extended or adjusted under 35 U.S.C. 154(b) by 327 days.

(21) Appl. No.: 12/346,583

(22) Filed: Dec. 30, 2008

(51) Int. Cl.
*F41B 15/04* (2006.01)
*H01T 23/00* (2006.01)

(52) U.S. Cl. ..... 361/232

(58) Field of Classification Search ..... 361/232
See application file for complete search history.

(56) References Cited

U.S. PATENT DOCUMENTS 5,955,695 A 9/1999 McNulty
7,042,696 B2 5/2006 Smith
7,057,872 B2 6/2006 Smith
7,145,762 B2 * 12/2006 Nerheim ..... 361/323

OTHER PUBLICATIONS

U.S. Appl. No. 11/771,240, Gavin.
U.S. Appl. No. 12/172,066, Chiles.

* cited by examiner

*Primary Examiner* — Stephen W Jackson
*Assistant Examiner* — Dharti H Patel
(74) *Attorney, Agent, or Firm* — William R. Bachand; Lawrence Letham

(57) ABSTRACT

An electronic demotivator demotivates a human by passing current via electrodes in tissue or spaced from tissue by a gap. The demotivator includes first and second energy sources, a power supply, and a switch. The first source couples to a first circuit for transferring energy through tissue. The switch conducts after an activation voltage exists. The first circuit includes the switch and first and second electrodes. Coupling causes a first voltage to be divided among the switch and the gap. If the activation voltage does not exist by coupling, the supply increases the energy of the second source for activation. By activation, the second source becomes part of a second circuit for transferring energy from the second source through tissue. The second circuit includes the switch and first and third electrodes to recover when coupling does not lead to ionizing air in the gap.

2 Claims, 3 Drawing Sheets

SYSTEMS AND METHODS FOR AN ELECTRONIC DEMOTIVATOR HAVING A RECOVERY SWITCH

BRIEF DESCRIPTION OF THE DRAWING

Embodiments of the present invention will be described with reference to the drawing, wherein like designations denote like elements, and.

DETAILED DESCRIPTION OF THE PREFERRED EMBODIMENTS

Figure 1:
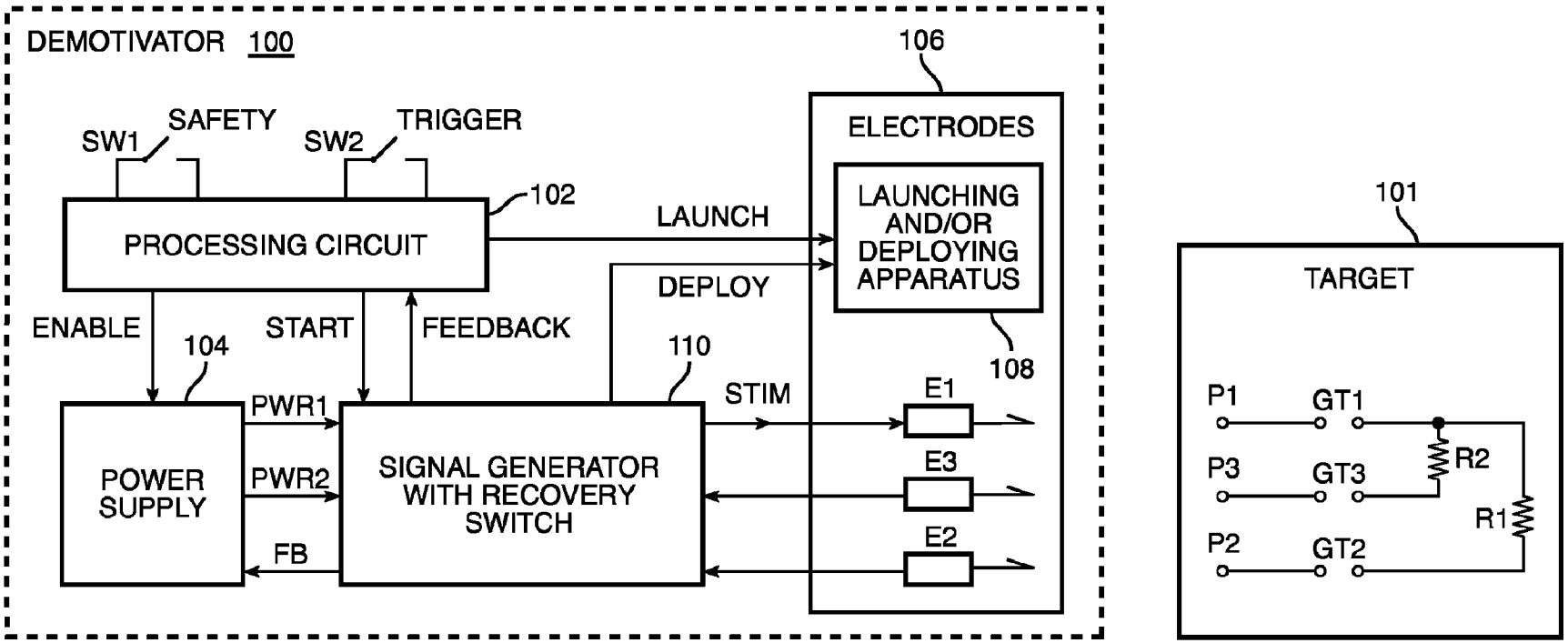
FIG. 1 is a functional block diagram of an electronic demotivator having a recovery switch, according to various aspects of the present invention.

Conventional electronic demotivators launch and/or deploy electrodes to contact a human or animal target to demotivate the target at a distance from the launcher. Demotivation is accomplished by conducting a stimulus current through target tissue. For successful demotivation, the stimulus current interferes with locomotion by the target by causing pain (e.g., psychologically unwilling to move) and/or causing skeletal muscle contractions (e.g., physiologically unable to move, halting locomotion by the target). The current is generated by a stimulus signal generator of the demotivator. The current includes a series of pulses. Each pulse may require an ionizing voltage to ionize air in gaps between target tissue and electrodes (e.g., lodged in clothing). When three or more electrodes are launched or deployed, a likelihood is increased for two of the electrodes to be in target tissue or suitably near target tissue (e.g., sum of air gap lengths less than about 2 inches). For law enforcement applications of electronic demotivators, halting locomotion is preferred over merely causing pain because a motivated target (e.g., one that does not feel pain or ignores pain) may continue to resist arrest unless his or her locomotion is halted.

An electronic demotivator, according to various aspects of the present invention, has an increased likelihood of causing general skeletal muscle contractions in a human or animal target. The increased likelihood results from launching and/or deploying at least three electrodes toward the target and recovering in the event that air in a gap between an electrode and target tissue is not ionized by an initial coupling of energy from the demotivator to that electrode. Recovery may include use of another of the at least three electrodes by operation of a switch. If recovery is successful, the opportunity to demotivate the target is not lost, but is recovered.

When two electrodes couple a stimulus signal generator of the demotivator to a target, pulsing current through the target tissue may cause pain, local skeletal muscle contractions, or general skeletal muscle contractions depending on various factors including current pulse width and length of an electrical circuit path through the target. When pulse width is relatively short (e.g., 5 microseconds, 10 microseconds, less than 100 microseconds) and/or electrical circuit path length is relatively short (e.g., less than one inch, less than 3 inches, about 5 inches) the stimulus signal merely causes pain. When pulse width is longer (e.g., from 50 to 200 microseconds) and electrical circuit path length is longer (e.g., more than about 7 inches) general skeletal muscle contractions are likely, halting locomotion by the target.

U.S. Pat. Nos. 7,042,696 to Smith entitled "Systems and Methods Using an Electrified Projectile", 7,057,872 to Smith entitled "Systems and Methods for Immobilization Using Selected Electrodes", 5,955,695 to McNulty entitled "Automatic Aiming Non-Lethal Area Denial Device", and U.S. patent application Ser. Nos. 11/771,240 to Gavin entitled "Systems and Methods for Deploying an Electrode Using Torsion" and 12/172,066 to Chiles entitled "Systems and Methods for Demotivating Using a Drape" are incorporated by reference each in its entirety for all purposes, regardless of the context of any further reference below, including teachings of electronic demotivator technologies (e.g., hand-held weapons, grenades, mines, area denial devices, drapes, electrified projectiles).

An electronic demotivator, according to various aspects of the present invention, may launch electrodes (e.g., wire-tethered electrodes, net of electrodes) or be launched as an electrified projectile that deploys electrodes (e.g., nose electrodes impact target and body electrodes deploy after impact). Such a demotivator may include a signal generator having a recovery switch. A signal generator may be included in the launching apparatus or included in a portion of the projectile. The signal generator may perform a method for recovery switching.

For example, demotivator 100 of FIG. 1 is operated to halt locomotion of target 101. Demotivator 100 includes processing circuit 102, power supply 104, electrodes 106, and signal generator 110. Electrodes may be part of the demotivator (e.g., baton, shield, grenade, projectile, single use hand-held device) or located in a replaceable unit (e.g., cartridge, round, magazine, drape). For example, electrodes 106 are part of demotivator 100 and include launching and/or deploying apparatus 108, and wire-tethered electrodes E1, E2, and E3.

A stimulus signal causes pain and/or contractions of skeletal muscles. For example, signal generator 110 provides stimulus signal STIM having a current comprising a series of pulses and a voltage measured across a pair of electrodes (e.g., E1-E2, E1-E3). Each pulse of the series may have a uniform pulse width of from 50 to 200 microseconds, preferably about 100 microseconds. The pulses of the series may have a repetition rate of from 2 to 40 pulses per second, preferably a repetition rate of greater than 12 pulses per second.

A human or animal target may be modeled as one or more circuits between points of coupling between electrodes and target tissue. A circuit through target tissue for passing stimulus signal current may be modeled as a resistance. In operation, electrodes from a demotivator become electrically coupled to tissue of a target either directly (e.g., impale skin) or indirectly (e.g., impale clothing and ionize air in a gap to target tissue). For example, target 101 includes a model of two circuits formed between three points of electrode coupling. Electrodes E1, E2, and E3 may lodge in clothing of target 101 at points of coupling P1, P2, and P3 forming respective air gaps at the target GT1, GT2, and GT3. A first circuit through target tissue from point of coupling P1 to point of coupling P2 includes target gap GT1, resistance R1, and target gap GT2. A second circuit through target tissue from point of coupling P1 to point of coupling P3 includes target gap GT1, resistance R2, and target gap GT3. Of course, if an electrode made direct impact with target tissue, no respective target gap would exist in series with that electrode.

An electrical path length through target tissue suitable for halting locomotion may be more likely to result between particular electrodes due to the design and operation of the demotivator and its electrodes. For example, when electrodes are launched at one or more angles from each other and spread to an increasing separation in flight, electrodes at the wider angle(s) are more likely to lodge at points of coupling suitable for causing general skeletal muscle contractions, as discussed above. For another example, when electrodes are arranged in a projectile (e.g., of the type described in U.S. Pat. No. 7,042,696 to Smith or application Ser. No. 11/771,240 to Gavin, discussed above) electrodes in a nose portion may be likely to be widely separated from electrodes in a tail portion due to separation of the nose portion and tail portion in flight or after impact (though these portions remain tethered to each other). A suitable electrical path length may result from wide physical separation. For yet another example, some electrodes of a nose portion of an electrified projectile of the type described in U.S. Pat. No. 7,057,872 to Smith face toward the target for impact with the target and some other electrodes face away from the target for impaling a hand of the target. By impaling the hand, a relatively long electrical path through target tissue is likely.

In the discussion that follows, assume that the circuit through resistance R1 of target 101 is preferred for demotivation due at least in part to an electrical path length between electrodes E1 and E2 that is expected to be longer than an electrical path length between electrodes E1 and E3. This expectation may be based on the design of demotivator 100, electrodes 106, launching and/or deploying apparatus 108, and/or electrodes E1, E2, and E3. For clarity of disclosure, only three electrodes are shown as part of electrodes 106. In other implementations according to various aspects of the present invention, more than three electrodes are used, with commensurate expansion of the other functions (e.g., increased capability, plural parallel capabilities) of electrodes 106 and/or demotivator 100.

A processing circuit performs a stored program to accomplish the functions of a demotivator. For example, processing circuit 102 includes a conventional programmable controller circuit having a microprocessor, memory, and analog to digital converter programmed to respond to safety switch SW1 and to trigger switch SW2 in any conventional manner (e.g., as in the model X26 hand-held demotivator marketed by TASER International, Inc.). For example, when safety switch SW1 is off and trigger switch SW2 is pulled, processing circuit 102 asserts control signal ENABLE to power supply 104 for the duration of a stimulus signal (e.g., 5 seconds, 10 seconds, 30 seconds); and asserts signal START to signal generator 110 at the beginning of each pulse of the duration to establish a pulse repetition rate (e.g., 5 to 40, pulses per second, 15 to 19 pulses per second). Processing circuit 102 receives signal FEEDBACK from signal generator 110 for metering charge delivered per pulse in any conventional manner; and responds by ceasing asserting signal START when a desired charge per pulse is delivered. Pulse delivery by signal generator 110 ceases when signal START is no longer asserted. Processing circuit 102 provides control signal LAUNCH to electrodes 106 to launch wire-tethered electrodes E1, E2, and E3 in any conventional manner.

In an implementation having reduced cost and complexity, processing circuit 102 is replaced with simpler logic and metering charge is omitted with commensurate modifications to power supply 104, signal generator 110, and electrodes 106. Power supply 104 may include a conventional timing circuit for tracking a suitable duration of the stimulus signal. Signal generator 110 in this implementation may include a conventional timing circuit for maintaining a desired pulse repetition rate. The functions of control signal LAUNCH may be performed by the control signal DEPLOY or stimulus signal STIM provided by signal generator 110.

In an implementation of demotivator 100 as an electrified projectile, processing circuit 102 may be omitted as discussed above and the functions of safety switch SW1 and trigger switch SW2 may be performed instead by a conventional switch that closes to apply power to the electrified projectile as a consequence of the electrified projectile separating from its shell during launching.

A power supply includes any circuitry that supplies power at voltages sufficient for ionization and stimulation. A power supply may respond to control signals from a signal generator and/or processing circuit to effect desired timing of its output voltages. A power supply may include analog and/or digital circuitry for determining the timing of its output signals (e.g., whether pulses are to be supplied, pulse width, pulse separation). For example, power supply 104 provides signals PWR1 and PWR2 to signal generator 110 in accordance with feedback signal FB. Each signal PWR1 and PWR2 includes, in a conventional manner, a series of pulses at a pulse width, repetition rate, and amplitude suitable for the functions of signal generator 110. Power supply 104 effects desired timing relationships among output signals PWR1 and PWR2. In response to signal FB, power supply 104 may supply signal PWR2 to provide additional energy to signal generator 110 (e.g., continue provision of pulses, restart provision of pulses, increase the amplitude of pulses, increase the pulse width).

A launching and/or deploying apparatus may propel and/or release electrodes to establish points of coupling between electrodes and target tissue, as discussed above. A launching apparatus of a cartridge of wire-tethered electrodes may propel electrodes from the cartridge by any conventional technology. For demotivator 100, launching and/or deploying apparatus 108 launches wire-tethered electrodes that have no deployment capability.

In an electrified projectile implementation of demotivator 100, a deployment apparatus 108 of the electrified projectile may deploy electrodes in any conventional manner from a stowed position suitable for packaging in a shell of a round to a deployed position suitable for conducting stimulus current through target tissue. For example, such a deployment apparatus may separate a nose portion and a tail portion to permit the tail portion to impact the target at a distance away from the point of impact of the nose portion. A deployment apparatus may further move or release electrodes of the nose portion and/or tail portion to increase the likelihood that an electrode tip will impale target tissue and/or lodge to support the inertia and weight of other portions of an electrified projectile.

An electrode includes any structure that conducts current through target tissue. An electrode couples to a target to provide a stimulus signal through the target. Electrodes may extend from a body of a projectile. Electrodes may be arranged relative to the body of a projectile to provide closely spaced electrodes and distantly spaced electrodes. Electrodes remain electrically coupled to the target for a period while the stimulus signal is passed through the target. In a law enforcement application, such a period allows arrest of the target (e.g., apply handcuffs, shackles). For example, electrodes E1, E2, and E3 include a conductive body and conductive barbed tip for lodging in clothing or tissue. Electrodes E1, E2, and E3 are electrically and mechanically coupled to signal generator 110. In another implementation, a projectile may impact a target in such a manner that some electrodes (e.g., located in a nose portion) are very likely to contact and/or embed into clothing or tissue of the target while other electrodes (e.g., located in a body or tail portion) are less likely to be positioned in or suitably near target tissue.

In a electrified projectile, electrodes may be retained in a stowed position prior to launch and moved to a deployed position to couple to a target and to provide a stimulus signal through the target. In a stowed position, the electrodes may be physically close to each other. A recoil force of impact of the projectile with a target may facilitate movement of electrodes from a stowed position to a deployed position.

A signal generator includes any circuit that forms pulses of stimulus signal current for delivery through two or more electrodes and through the target. Pulse timing may be controlled by digital circuitry and/or analog circuitry of the signal generator. Pulse formation generally includes the storage and release of energy. For example, signal generator 110 generates pulses of current that constitute stimulus signal STIM. Signal generator 110 includes a capacitance charged by signal PWR1 and another capacitance charged by signal PWR2. Release of energy from one or both capacitors forms a pulse of current for stimulus signal STIM as discussed above. Whether or not electrodes are effectively coupled to the target so as to pass a current pulse of stimulus signal STIM is reflected in feedback signal FB, used by power supply 104 to control output of signal PWR2 to signal generator 110. If electrodes are not effectively coupled, signal FB is asserted and power supply 104 provides additional power to signal generator 110. The additional power may be used to activate a recovery switch of signal generator 110. Positive (or negative) circuit logic may be used for signal FB and/or the recovery switch. For instance, when the recovery switch is open (closed) in an initial condition, stimulus signal STIM is delivered in a circuit that includes electrodes E1 and E2. When the recovery switch is closed (open) in a second condition, stimulus signal STIM is delivered in a circuit that includes electrodes E1 and E3. Operation of the recovery switch by signal generator 110 allows demotivator 100 to recover from the event that electrodes E1 and E2, preferred for likely effective halting of locomotion, are not effectively coupled (or cannot be effectively coupled) to target tissue.

When demotivator 100 constitutes an electrified projectile, demotivator 100 may be packaged as a round for launching from a firearm (e.g., a 12 gauge shot gun). A round protects an electrified projectile from damage prior to use. A round contains a projectile prior to launching toward a human or animal target to provide a stimulus signal through the target. For example, a round may include a base and a shell that surrounds the electrified projectile. The base may include a propellant to propel the projectile toward the target. A round may be chambered in a conventional launcher (e.g., firearm, grenade launcher, air gun). A propulsion system propels an electrified projectile away from the round and toward the target. Conventional propellants (e.g., rapid expansion of a burning gas, release of a compressed gas, mechanical propulsion) and techniques (e.g., percussion activation, electric activation) may be used. For example, a propulsion system that remains in the base of a round may be percussion activated, and include gun powder sufficient to propel an electrified projectile through the barrel of a shot gun and about 100 feet down range.

An electrified projectile, according to various aspects of the present invention, includes any structure for delivering a current through a target using recovery switching. For instance, an electrified projectile may include a nose portion and a tail portion that separate to distance one or more electrodes in the nose portion from one or more electrodes in the tail portion. A power supply, signal generator, and deployment apparatus may be located in any suitable portion. For example, an electrified projectile may include a body coupled by a tether to a nose portion. The body may include the power supply, signal generator, deployment apparatus, and deployable tail electrodes. The distance between nose-to-tail electrodes after impact with a target is preferably suitable for causing general skeletal muscle contractions. The electrodes of a projectile may be held relatively close together prior to launch; and, later (e.g., after launch, after target impact) deploy (e.g., spread, move, release) to provide relatively more distance between electrodes at the target. Electrodes may deploy from the relatively close together position at any time after launch (e.g., upon exiting a barrel, prior to contacting a target, after impact with a target). An electrode may be formed of spring wire having a barbed tip to lodge in target's clothing or tissue. For a projectile that separates into two or more portions tethered together, impact electrodes when lodged in target clothing or tissue generally restrain the movement of the tethered portions and support the weight of tethered portions at rest. One or more tethered portions may each include one or more deployed electrodes. For example, electrodes may include a plurality of impact electrodes arranged in a nose portion and at least one electrode arranged in a tail portion. After launch toward a target, electrodes may arrive at the target in one or more positions, some of which may be more suitable for conducting current through the target (e.g., nose-to-tail preferred over nose-to-nose). Because the effect of launch and the orientation of the target cannot be predicted, a signal generator, according to various aspects of the present invention, includes a recovery switch and performs a method for recovery switching.

Figure 2:
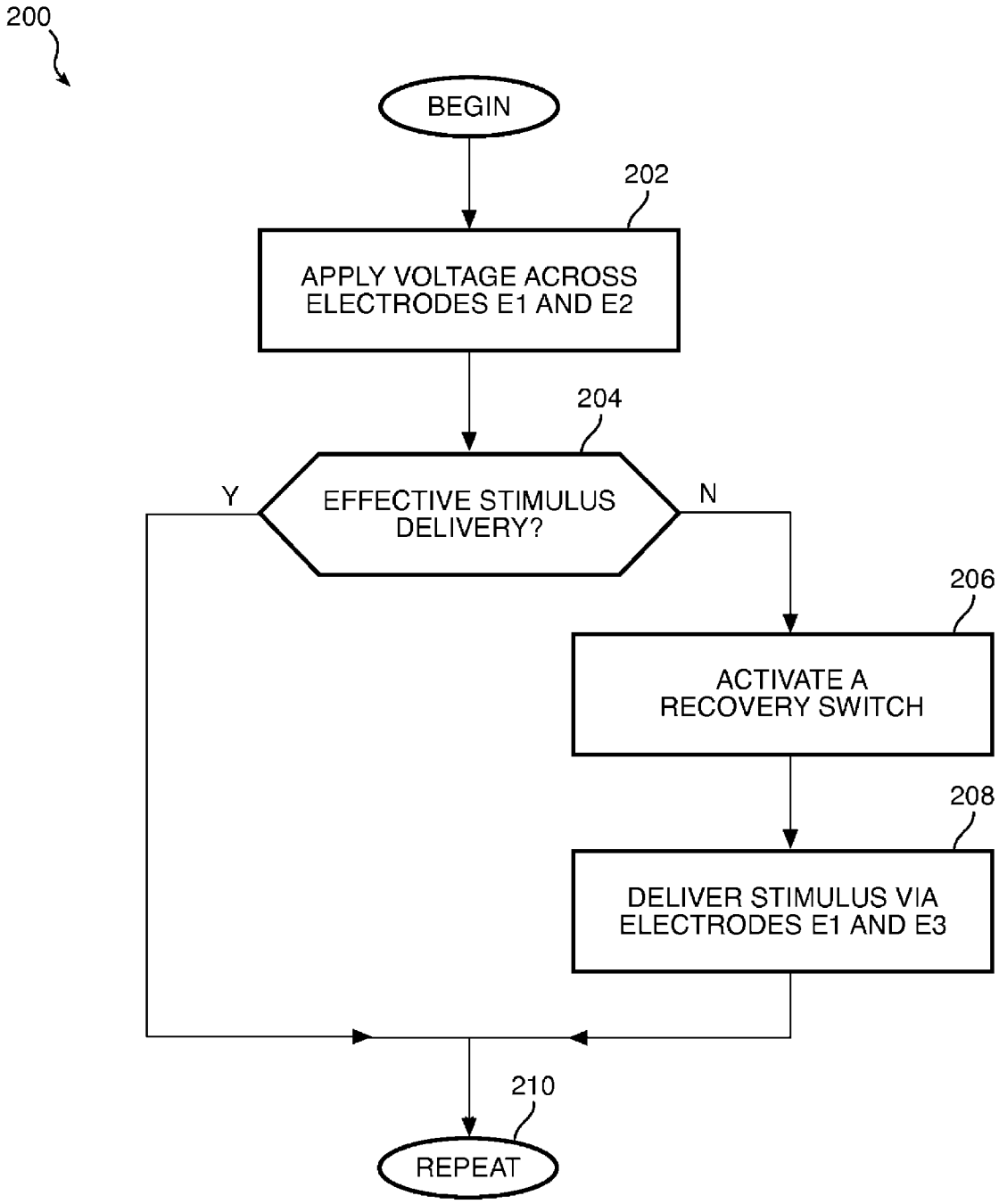
FIG. 2 is flow chart of a method for recovery switching, according to various aspects of the present invention.

A method for recovery switching 200 of FIG. 2 may be performed by a demotivator 100 or a signal generator 110 of a demotivator. A result of one performance of the method is the delivery of one pulse of stimulus signal current through target tissue. Assuming that electrodes E1, E2, and E3 are at points of coupling P1, P2, and P3 as discussed above, method 200 begins with applying (202) a voltage (signal STIM) across electrodes E1 and E2. The voltage may be a multiplied voltage (e.g., about 50 kilovolts for expected gaps totaling about 2 inches).

If (204), as a result of applying (202) the voltage across electrodes E1 and E2, stimulus current is effectively delivered, then no recovery is necessary. Stimulus signal current is delivered through a first circuit that includes electrodes E1 and E2. The first circuit may also include the recovery switch. In a demotivator where delivery of a pulse of stimulus current results from discharge of a capacitance, whether or not stimulus signal current is effectively delivered may be determined by observing a voltage measured across the capacitance (e.g., an absolute valve decrease, a rate of absolute value decrease). For example, if the absolute value of a magnitude of such a voltage decreases by more than 10 percent (e.g., 80 percent) of an expected extent of discharging of the capacitance, delivery may be deemed effective. For instance, by design, the capacitance may be substantially fully discharged (e.g., 3 to 5 time constants) for effective delivery of one pulse or pulse width of stimulus signal current. Determining effective stimulus delivery may be attempted soon after applying (202) a voltage across electrodes E1 and E2 (e.g., less than one time constant). A time constant may be based on the magnitude of the capacitance and the magnitude of all resistances in the discharge path(s) such as R1 of target 101 and resistance of tether wires.

A failure to adequately discharge the capacitance and consequently a failure to deliver sufficient current through target tissue may be attributed to the existence of one or more gaps (e.g., GT2) having a combined length that requires for ionization a voltage beyond the absolute value magnitude of stimulus signal STIM. If, in addition to gap GT2, other gaps are in series with gap GT2 and also require ionization (e.g., gap GT1 exists, recovery switch comprises a gap, electrodes E1 and/or E2 comprise a gap), the sum of all gap lengths in the series circuit will dictate a minimum voltage for ionization of all the gaps simultaneously. The minimum voltage is divided to form a respective voltage across each gap. If signal generator 110 cannot output at least the minimum voltage essentially no current will discharge from the capacitance and no current will pass through the series circuit that includes these gaps and resistance R1 of target 101. For example, in a demotivator where delivery of a pulse of stimulus signal current results from discharge of a capacitance, if a voltage across the capacitance remains the same or decreases by less than 10 percent (e.g., 5 percent) of an expected extent of discharging of the capacitance, delivery may be deemed ineffective, analogous to the opposite of successful delivery discussed above.

If (204) stimulus current is not effectively delivered, then a recovery switch is activated (206). For example, when the recovery switch is a voltage activated switch, activation may include increasing a voltage of suitable polarity across the switch crossing an activation voltage threshold of the switch. Increasing a voltage across the switch may be accomplished by increasing an energy supplied by signal PWR2 to signal generator 110 as discussed above.

As a result of activation, stimulus signal STIM current may be delivered (208) via a second circuit that includes the recovery switch, and electrodes E1 and E3.

In either event defined by the condition (204) of whether recovery is not required or recovery is to be attempted, method 200 may be repeated (210) for each pulse of stimulus signal STIM current.

A recovery switch may include a semiconductor device (e.g., MOSFET, JFET, SCR, bipolar transistor, diode for alternating current). A recovery switch may include a varister. A recovery switch may include a spark gap, preferred for low cost.

Figure 3:
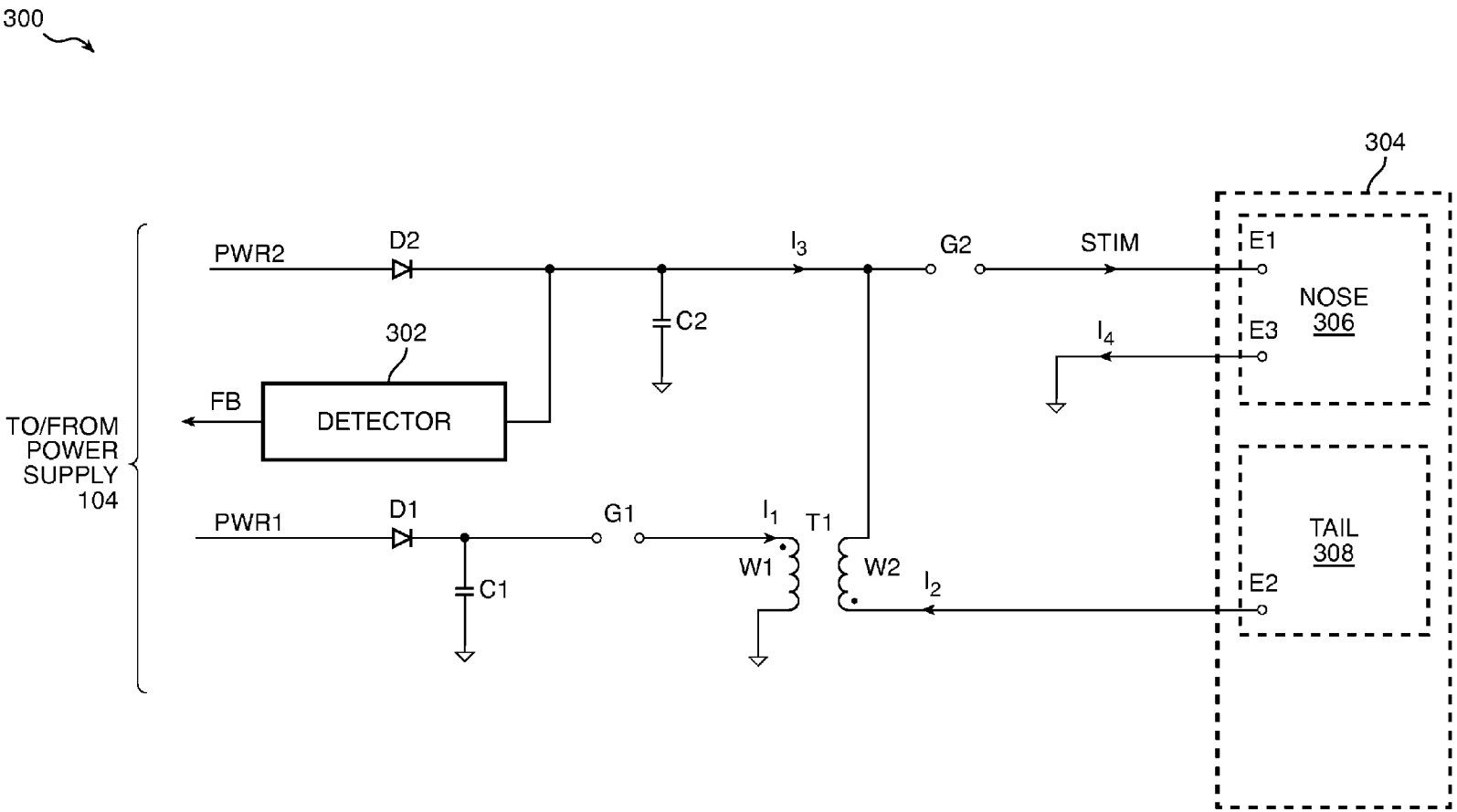
FIG. 3 is a schematic diagram of a portion of a signal generator for a projectile according to the block diagram of FIG. 1.

Signal generator 110 may include a circuit 300 of FIG. 3 having a recovery switch. Circuit 300 performs method 200 for activating the recovery switch as needed for each pulse of a stimulus signal STIM current. Circuit 300 includes a first energy source that provides a multiplied voltage. The first energy source includes diode D1, capacitor C1, spark gap G1, and step up transformer T1. Circuit 300 further includes a second energy source that includes diode D2, capacitor C2, and detector 302. The recovery switch is implemented with spark gap G2 (also called recovery switch G2), coupled to both the first energy source and the second energy source. The recovery switch G2 is in series with electrode E1.

Operation of circuit 300 is discussed below with an assumption for clarity of presentation. Circuit 300 is assumed to be part of an implementation of an electrified projectile having electrodes 304 located in a nose portion 306 and a tail portion 308, as discussed above. Electrodes E1 and E3 are located in nose portion 306 suitable for causing pain with a physical distance between electrodes of less than 5 inches (e.g., less than 1 inch, about 0.2 inch). Electrode E2 is located in tail portion 308. Electrodes E1 and E2 are likely to be suitable for halting locomotion because tail portion 308 may be deployed up to about 15 inches from nose portion 306. Of course, other implementations of a demotivator as discussed above may include circuit 300 with other suitable electrode configurations.

Stimulus signal STIM current preferably passes through target tissue in a first circuit between electrodes E1 and E2 involving recovery switch G2, gap GT1 (if it exists), resistance R1, and gap GT2 (if it exists). If delivery of current is ineffective, stimulus signal STIM current may pass through target tissue in a second circuit between electrodes E1 and E3 involving recovery switch G2, gap GT1 (if it exists), resistance R2, and gap GT3 (if it exists). As shown, both the first circuit and the second circuit also include recovery switch G2, activated to conduct the STIM current.

In operation, capacitors C1 and C2 are charged (e.g., concurrently, sequentially) respectively by signals PWR1 and PWR2 through diodes D1 and D2. Spark gap G1 is initially open so capacitor C1 is not coupled to transformer T1 until spark gap G1 conducts. When the voltage across capacitor C1 is sufficient to ionize spark gap G1, the voltage across capacitor C2 is not sufficient to ionize spark gap G2. Consequently, when gap G1 ionizes and conducts current I1 through primary winding W1 of transformer T1, energy from capacitor C1 is transferred to a magnetic field in transformer T1. A multiplied voltage then exists across secondary winding W2 of transformer T1. The multiplied voltage is coupled across electrodes E1 and E2.

If (204) the multiplied voltage exceeds the sum of the ionization voltages of all gaps in series with secondary winding W2 (the first circuit), then all such gaps ionize and conduct one current pulse of stimulus signal STIM. The stimulus signal STIM current results from a transfer of energy from capacitor C1 via transformer T1. The stimulus signal STIM current returns as I2 to secondary winding W2. Stimulus signal STIM current also results from a transfer of energy from capacitor C2 to circuit common via electrodes E1 and E3 as current I4, when both nose electrodes couple to target tissue. Detector 302 provides signal FB to power supply 104 conveying indicia of substantial discharge of capacitor C2.

If (204) on the other hand, the multiplied voltage is not sufficient to ionize all gaps in the first circuit, detector 302 provides signal FB to power supply 104 conveying indicia of not substantial discharge of capacitor C2. Not substantial discharge of capacitor C2 indirectly conveys indicia of ineffective delivery of current through target tissue as discussed above.

In response to signal FB, power supply 104 may resume or continue charging of capacitor C2. Charging responsive to indicia of ineffective delivery of stimulus signal STIM current by signal FB may include charging by signal PWR2 having an increased voltage amplitude.

Spark gap G2 is initially open so capacitor C2 is not coupled to electrodes E1 and E3 until spark gap G2 conducts. If and when the voltage across capacitor C2 exceeds (206) the ionization voltage of spark gap G2, spark gap G2 conducts a pulse of stimulus signal STIM current through the second circuit, returning to circuit common as current I4. The stimulus signal STIM current results from a transfer of energy from capacitor C2 as current I3.

A detector includes any circuit that monitors a source of energy and provides indicia of stored energy and/or change in stored energy. A detector may include a comparator that compares stored energy (and/or change in stored energy) to a limit. For example, detector 302 measures a voltage across capacitor C2 particularly at a time soon after gap G1 begins conducting (predictable from the charging rate of capacitor C1). If the measured voltage (or change in voltage) indicate substantial discharging of capacitor C2, detector 302 does not assert signal FB. Otherwise, signal FB is asserted.

In another implementation, according to various aspects of the present invention, detector 302 is omitted. The rates of charging capacitors C1 and C2 and the pulse amplitudes of signals PWR1 and PWR2 for charging of capacitors C1 and C2 are designed to effect continuing of charging of capacitor C2 in the event that recovery is to be attempted. In this implementation, the amplitude of signal PWR2 may remain unchanged.

In another implementation, according to various aspects of the present invention, the first source of energy provides a multiplied voltage using a flyback effect of an inductance (e.g., transformer T1 is a flyback transformer).

In other implementations, according to various aspects of the present invention, the first source of energy and the second source of energy may include any conventional energy storage devices (e.g., capacitance, inductance) and conventional circuit techniques to accomplish pulse formation, timing, switching, and/or voltage multiplication functions (e.g., voltage doublers, autotransformers, transformers with multiple secondary windings).

In an implementation, according to various aspects of the present invention, where the recovery switch includes a semiconductor device, the activation voltage threshold may correspond to a junction control voltage (e.g., a gate source voltage, a trigger voltage). Activation may include providing the junction control voltage in response to comparing the utilization of the second source of energy to the utilization of the first source of energy. The comparison may be made between respective normalized stored energies (e.g., percentage of fully charged stored energy). For example, if capacitor C2 is charged to 80% of full charge (so as not to activate recovery switch G2) while capacitor C1 is charged to 100% of full charge, the percentage of utilization of capacitor C2 will not substantially exceed (e.g., differ by more than 10% to allow for measurement errors and tolerances) the percentage of utilization of capacitor C1 unless delivery of stimulus current has been ineffective (204) and recovery should be attempted. A suitable junction control signal to activate a recovery switch may be responsive to such a result of comparison.

The foregoing description discusses preferred embodiments of the present invention, which may be changed or modified without departing from the scope of the present invention as defined in the claims. The examples listed in parentheses may be alternative or combined in any manner. The invention includes any practical combination of the structures and method steps disclosed. While for the sake of clarity of description several specifics embodiments of the invention have been described, the scope of the invention is intended to be measured by the claims as set forth below.

What is claimed is:

1. An electronic demotivator for demotivating a human or animal target by passing a current through tissue of the target via at least two of a plurality of electrodes comprising a first electrode, a second electrode, and a third electrode launched and/or deployed to contact the tissue directly or via a respective target gap, the demotivator comprising:

a. a first source of energy initially coupled to a first circuit for transferring energy from the first source through target tissue;

b. a second source of energy; and c. a power supply;

d. a switch that conducts when an activation voltage threshold of the switch is crossed; wherein (1) the first circuit comprises the first electrode, the second electrode, and the switch;

(2) initially coupling gives rise to a first voltage divided among the switch and a particular target gap;

(3) if the activation voltage threshold of the switch is not crossed as a consequence of initially coupling, the power supply increases an energy delivery capability of the second source of energy giving rise to a second voltage to cross the activation voltage threshold of the switch;

(4) by activation of the switch, the second source of energy is made part of a second circuit for transferring energy from the second source through target tissue; and (5) the second circuit comprises the first electrode, the third electrode, and the switch to recover when initially coupling does not lead to ionizing air in the particular target gap.

2. A method for demotivating a human or animal target by passing a current through tissue of the target via at least two of a plurality of electrodes comprising a first electrode, a second electrode, and a third electrode launched and/or deployed to contact the tissue directly or via a respective target gap, the method comprising in sequence:

initially coupling a first source of energy to a first circuit for transferring energy from the first source through target tissue, wherein the first circuit comprises the first electrode, the second electrode, and a switch, coupling gives rise to a first voltage divided among the switch and a particular target gap, and the switch is able to conduct after an activation voltage threshold of the switch is crossed;

if the activation voltage threshold of the switch is not crossed as a consequence of initially coupling, increasing an energy delivery capability of the second source of energy giving rise to a second voltage to cross the activation voltage threshold of the switch, wherein by activation of the switch, the second source of energy is made part of a second circuit for transferring energy from the second source through target tissue, and the second circuit comprises the first electrode, the third electrode, and the switch to recover when initially coupling does not lead to ionizing air in the particular target gap.

* * * * *